US010529466B1

(12) United States Patent
Zuo

(10) Patent No.: US 10,529,466 B1
(45) Date of Patent: Jan. 7, 2020

(54) PLUG WITH WIRELESS COMMUNICATION

(71) Applicant: Wellgreen Technology Incorporation, Dongguan (CN)

(72) Inventor: Xiangling Zuo, Dongguan (CN)

(73) Assignee: WELLGREEN TECHNOLOGY INCORPORATION, Dongguan (CN)

( * ) Notice: Subject to any disclaimer, the term of this patent is extended or adjusted under 35 U.S.C. 154(b) by 0 days.

(21) Appl. No.: 16/053,918

(22) Filed: Aug. 3, 2018

(51) Int. Cl.
*H01B 9/00* (2006.01)
*H01R 13/6585* (2011.01)
*H01R 13/70* (2006.01)

(52) U.S. Cl.
CPC ..... *H01B 9/003* (2013.01); *H01R 13/6585* (2013.01); *H01R 13/701* (2013.01)

(58) Field of Classification Search
CPC ..... H01R 24/68; H01R 25/003; H01R 24/66
USPC ..... 174/113 R; 439/687; 429/188
See application file for complete search history.

(56) References Cited

U.S. PATENT DOCUMENTS 1,595,003 A * 8/1926 Downing ..... H01R 27/00 439/687
1,757,437 A * 5/1930 Muldoon ..... H01R 24/20 439/687
2,272,432 A * 2/1942 Rogie ..... H01R 4/20 439/680
2,528,971 A * 11/1950 Philips ..... H01R 13/68 337/263
3,023,267 A * 2/1962 Eager, Jr. ..... H01B 7/00 174/115
3,273,105 A * 9/1966 Klassen ..... H01R 13/533 439/687
3,942,859 A * 3/1976 Korodi ..... G02B 6/4416 439/490
4,275,374 A * 6/1981 Chaucer ..... H01R 13/68 337/197
4,352,540 A * 10/1982 Liu ..... H01R 13/512 439/696
4,405,194 A * 9/1983 van Lierop ..... H01R 13/504 439/606
4,755,629 A * 7/1988 Beggs ..... H01B 11/02 174/115
4,868,565 A * 9/1989 Mettes ..... H01B 11/1033 340/854.9
5,393,237 A * 2/1995 Roy ..... H01R 13/60 439/133
5,457,445 A * 10/1995 Su ..... H01R 13/68 337/198
6,933,447 B1 * 8/2005 Marc ..... H01R 24/20 174/135

(Continued)

*Primary Examiner* — William H. Mayo, III
*Assistant Examiner* — Krystal Robinson

(57) ABSTRACT

A plug with wireless communication includes a plug main body and a cable. The plug main body includes a housing, a wireless communication module and power supply pins. The wireless communication module is mounted inside the housing. The power supply pins are connected to the housing. The cable sequentially includes a communication wire, a power wire and an outer cladding from inside to outside. The power wire is arranged and distributed on the periphery of the communication wire. The outer cladding enwraps the power wire. The wireless communication module is connected to the communication wire. The power supply pins are connected to the power wire.

17 Claims, 8 Drawing Sheets

(56) References Cited

U.S. PATENT DOCUMENTS

| | | | | |
|---|---|---|---|---|
| 8,029,318 | B2 * | 10/2011 | Namiki | H01R 24/30 439/106 |
| 9,736,531 | B2 * | 8/2017 | Collins | H04N 21/43635 |
| 2004/0014352 | A1 * | 1/2004 | Boemmel | G02B 6/4478 439/445 |
| 2005/0272293 | A1 * | 12/2005 | Irwin | H01R 13/6276 439/180 |
| 2006/0110963 | A1 * | 5/2006 | Cheng | H01R 13/6675 439/171 |
| 2007/0141869 | A1 * | 6/2007 | McNeely | A61B 5/0006 439/76.1 |
| 2007/0141894 | A1 * | 6/2007 | McGinley | H01R 13/6658 439/447 |
| 2012/0190225 | A1 * | 7/2012 | Bessyo | H01R 13/64 439/177 |
| 2012/0222880 | A1 * | 9/2012 | Dinh | H02G 3/088 174/50 |
| 2013/0069617 | A1 * | 3/2013 | Lee | H01R 31/065 323/318 |
| 2014/0313042 | A1 * | 10/2014 | Scherer | H01R 13/641 340/660 |
| 2016/0104988 | A1 * | 4/2016 | Lee | H01R 13/6675 439/620.21 |
| 2016/0197561 | A1 * | 7/2016 | Riphin | H02M 7/003 363/146 |
| 2016/0305992 | A1 * | 10/2016 | Yeo | H04W 4/80 |
| 2018/0083402 | A1 * | 3/2018 | Higashiura | H01R 33/06 |
| 2019/0058249 | A1 * | 2/2019 | Ma | H01B 9/00 |
| 2019/0068095 | A1 * | 2/2019 | von Sebo | H02P 29/50 |

* cited by examiner

PLUG WITH WIRELESS COMMUNICATION

TECHNICAL FIELD

The invention relates to the technical field of plugs, in particular to a plug with wireless communication.

BACKGROUND

Plugs are essential requirement of connecting elements for various electrical appliances to connect to power supplies. The existing plugs are complicated in structural design and connected by welding, which is easy to cause poor contact of plugs. The existing plug only connects power supply, providing one single function. The communication module in the existing plug is typically employed with various electrical appliances, but the interference with the communication module from the electrical appliances during operation is relatively large. The power wire of the existing plug can only transmit electric current and cannot transmit other communication signals, so there is an urgent need for a new type of plug with wireless communication.

SUMMARY

In order to overcome the shortcomings of the prior art, the invention provides a plug with wireless communication, which solves the problem of interference from electrical appliances with communication by providing a wireless communication module inside the plug.

The invention provides a plug with wireless communication, which comprises a plug main body and a cable. The plug main body comprises a housing, a wireless communication module and power supply pins. The wireless communication module is mounted inside the housing. The power supply pins are connected to the housing. The cable sequentially comprises a communication wire, a power wire and an outer cladding from inside to outside. The outer cladding enwraps the power wire and the communication wire. The wireless communication module is connected to the communication wire. The power supply pins are connected to the power wire.

Further, the housing comprises an upper cover and a lower cover; the upper cover is of an open housing structure, one side surface of the upper cover being provided with a wire threading notch; and an end of the cable is provided with a clamping groove which cooperates with the wire threading notch.

Further, an inner surface of the lower cover is provided with a mounting trough in which the wireless communication module is mounted; and an inner surface of the upper cover is provided with a positioning trough, the positioning trough pressing against the wireless communication module.

Further, the communication wire sequentially comprises a signal wire and a shielding layer from inside to outside, and the shielding layer enwraps the signal wire.

Further, the cable further comprises an inner cladding and a filler, the inner cladding enwraps the shielding layer, the filler is arranged and distributed on the periphery of the communication wire, and the outer cladding enwraps the power wire and the filler.

Further, the power wire comprises three power signal wires with a specification ranging from 12 AWG to 20 AWG, the power supply pins include a naught wire pin and a live wire pin, and the naught wire pin as well as the live wire pin are respectively connected to the power signal wires.

Further, the signal wire comprises four communication signal wires with a specification ranging from 24 AWG to 38 AWG and one communication ground wire with a specification ranging from 20 AWG to 26 AWG, the shielding layer enwraps the communication signal wires and the communication ground wire, and the communication signal wires and the communication ground wire are respectively connected to the wireless communication module.

A plug with wireless communication comprises a plug main body and a cable. The plug main body comprises a housing, a wireless communication module and power supply pins. The wireless communication module is mounted inside the housing. The housing comprises an upper cover and a lower cover. An inner surface of the lower cover is provided with a mounting member on which the wireless communication module is mounted. An inner surface of the upper cover is provided with a positioning trough. The positioning trough presses against the wireless communication module. The power supply pins are riveted to the lower cover. The wireless communication module and the power supply pins are respectively connected to the cable.

Further, the upper cover is of an open housing structure, one side surface of the upper cover being provided with a wire threading notch; and an end of the cable is provided with a clamping groove which cooperates with the wire threading notch.

Further, the mounting member comprises a mounting trough, and the mounting trough is provided on the inner surface of the lower cover, the wireless communication module being mounted in the mounting trough.

Further, the cable sequentially comprises a communication wire, a power wire and an outer cladding from inside to outside, the communication wire sequentially comprises a signal wire and a shielding layer from inside to outside, the shielding layer enwraps the signal wire, the power wire is arranged and distributed on the periphery of the communication wire, and the outer cladding enwraps the power wire.

Further, the cable further comprises an inner cladding and a filler, the inner cladding enwraps the shielding layer, the filler is arranged and distributed on the periphery of the communication wire, and the outer cladding enwraps the power wire and the filler.

Further, the power wire comprises three power signal wires with a specification ranging from 12 AWG to 20 AWG, the power supply pins include a naught wire pin and a live wire pin, and the naught wire pin and the live wire pin are respectively connected to the power signal wires.

Further, the signal wire comprises three communication signal wires with a specification ranging from 24 AWG to 38 AWG and one communication ground wire with a specification ranging from 20 AWG to 26 AWG, the shielding layer enwraps the communication signal wires and the communication ground wire, and the communication signal wires and the communication ground wire are respectively connected to the wireless communication module.

A plug with wireless communication comprises a plug main body and a cable. The plug main body comprises a housing, a wireless communication module and power supply pins. The wireless communication module is mounted inside the housing. The housing comprises an upper cover and a lower cover. The power supply pins are riveted to the lower cover. The upper cover is of an open housing structure. One side surface of the upper cover is provided with a wire threading notch. An end of the cable is provided with a clamping groove which cooperates with the wire threading notch. The wireless communication module and the power supply pins are respectively connected to the cable.

Further, an inner surface of the lower cover is provided with a mounting trough in which the wireless communication module is mounted.

Further, an inner surface of the upper cover is provided with a positioning trough, the positioning trough pressing against the wireless communication module.

Further, the cable sequentially comprises a communication wire, a power wire and an outer cladding from inside to outside, the communication wire sequentially comprises a signal wire and a shielding layer from inside to outside, the shielding layer enwraps the signal wire, the power wire is arranged and distributed on the periphery of the communication wire, and the outer cladding enwraps the power wire.

Further, the cable further comprises an inner cladding and a filler, the inner cladding enwraps the shielding layer, the filler is arranged and distributed on the periphery of the communication wire, and the outer cladding enwraps the power wire and the filler.

Further, the power wire comprises three power signal wires with a specification ranging from 12 AWG to 20 AWG, the power supply pins include a naught wire pin and a live wire pin, and the naught wire pin and the live wire pin are respectively connected to the power signal wires; and the signal wire comprises two communication signal wires with a specification ranging from 24 AWG to 38 AWG and one communication ground wire with a specification ranging from 20 AWG to 26 AWG, the shielding layer enwraps the communication signal wires and the communication ground wire, and the communication signal wires and the communication ground wire are respectively connected to the wireless communication module.

Compared to the prior art, the beneficial effects of the invention are as follows:

The invention provides a plug with wireless communication, and by connecting power supply pins to a lower cover and connecting the power supply pins to a power wire, the connection between the power supply pins and the lower cover and the power wire is firm and stable, the plug provides good contact, and the problem of poor contact of the plug in the prior art caused by using welding for connection is effectively solved. By mounting a wireless communication module inside the plug, the interference with the wireless communication module from various electrical appliances during operation is effectively reduced. By providing a mounting trough integrated with an inner surface of the lower cover or a mounting bracket mounted on the inner surface of the lower cover, the plug can be assembled according to the actual situation of the wireless communication module and the cable. By providing a communication wire inside the cable, the cable of the plug can transmit not only electric current but also communication signals. By enwrapping a signal wire with an inner cladding and a shielding layer, the power wire and the signal wire are isolated from each other, thus greatly improving the shielding effect, resulting in strong anti-interference capability and improving the data transmission efficiency and quality. By providing different numbers of communication signal wires in the communication wire, corresponding cables can be selected for assembly of the plug according to different wireless communication modules in actual use, so that the plug can be connected to external wireless products, transmit data and meet different use requirements. The plug of the invention is simple in structure, convenient in management of the cable, and easy to carry and use, facilitating people's work and life, and being conducive to widespread.

The description above is only an overview of the technical solutions of the invention. In order to clearly understand the technical means of the invention, the invention can be implemented according to the contents of the description. Preferred embodiments are described in detail below with reference to the accompanying drawings. Particular implementations of the invention are given in detail by the following embodiments and accompanying drawings thereof.

BRIEF DESCRIPTION OF THE DRAWINGS

The drawings described herein are used to provide a further understanding of the invention and constitute a part of the present application. The exemplary embodiments of the invention and descriptions thereof are used to explain the invention, and do not constitute improper limits to the invention. In the drawings.

Figure 1:
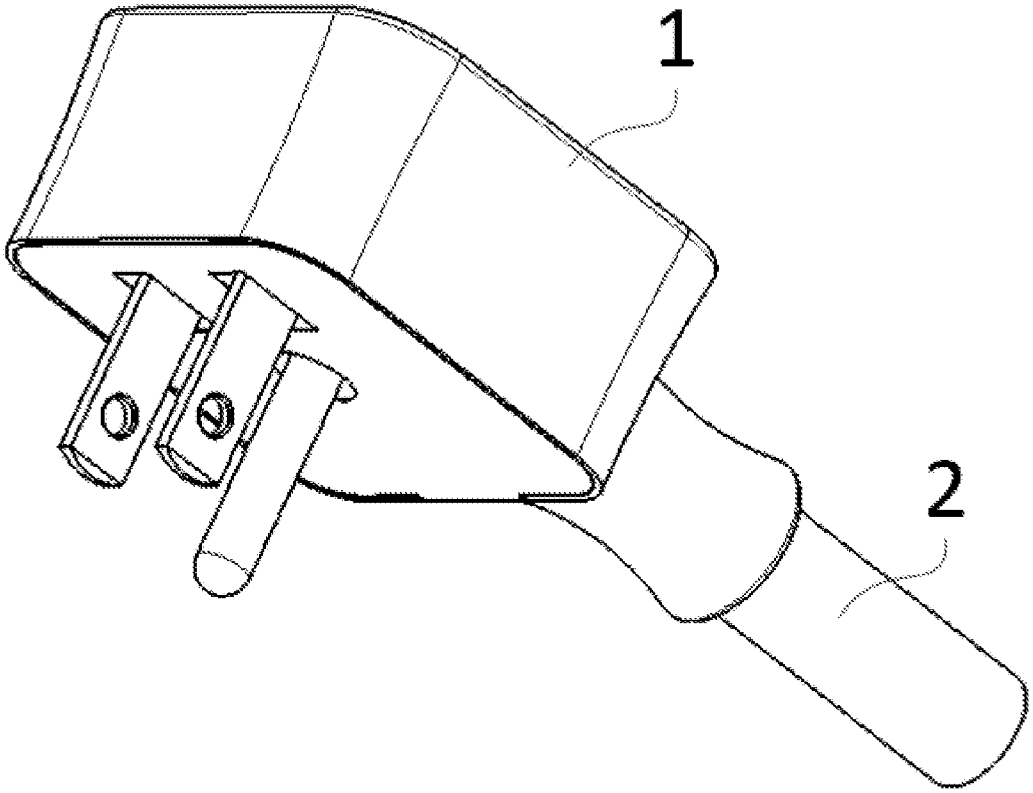
FIG. 1 is a schematic diagram of the overall structure of a plug with wireless communication of the invention.

In the drawings: 1. plug main body; 11. upper cover; 111. wire threading notch; 112. positioning trough; 12. lower cover; 121. mounting trough; 13. wireless communication module; 14. power supply pin; 15. mounting bracket; 2. cable; 20. communication wire; 201. shielding layer; 202. signal wire; 203. inner cladding; 21. power wire; 211. power signal wire; 22. outer cladding; 23. filler; 24. clamping groove.

DETAILED DESCRIPTION OF EMBODIMENTS

The invention will be further described with reference to the accompanying drawings and particular embodiments. It should be noted that, on the premise of no conflict, embodiments or technical features described below can be arbitrarily combined to form new embodiments.

Figure 2:
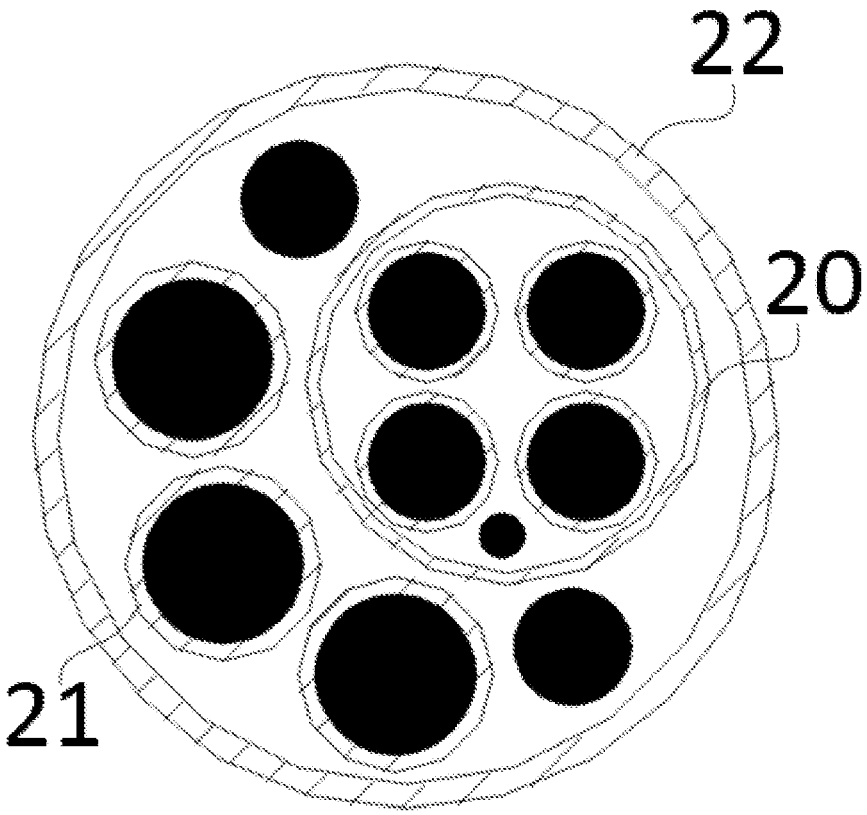
FIG. 2 is a first schematic diagram of the cross-sectional structure of a cable of the invention.
Figure 5:
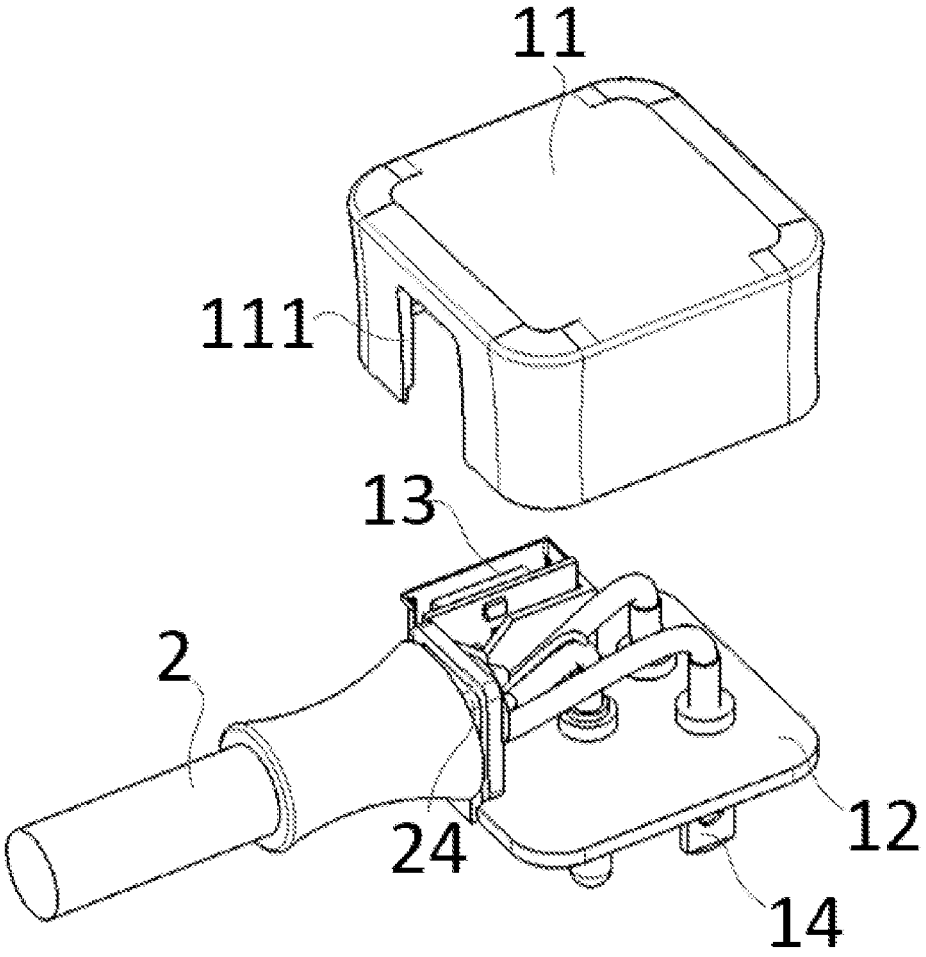
FIG. 5 is a first schematic diagram of the exploded structure of a plug with wireless communication of the invention.

A plug with wireless communication, as shown in FIGS. 1 and 5, comprises a plug main body 1 and a cable 2. The plug main body 1 comprises a housing, a wireless communication module 13 and power supply pins 14. The wireless communication module 13 is mounted inside the housing. The power supply pins 14 are riveted to the housing. As shown in FIG. 2, from inside to outside, the cable 2 sequentially comprises a communication wire 20, a power wire 21 and an outer cladding 22. The power wire 21 is arranged and distributed on the periphery of the communication wire 20. The outer cladding 22 enwraps the power wire 21. The wireless communication module 13 is connected to the communication wire 20. The power supply pins 14 are connected to the power wire 21. By mounting the wireless communication module 13 inside the plug main body 1, the interference with the wireless communication module 13 from various electrical appliances during operation is effectively reduced.

Figure 6:
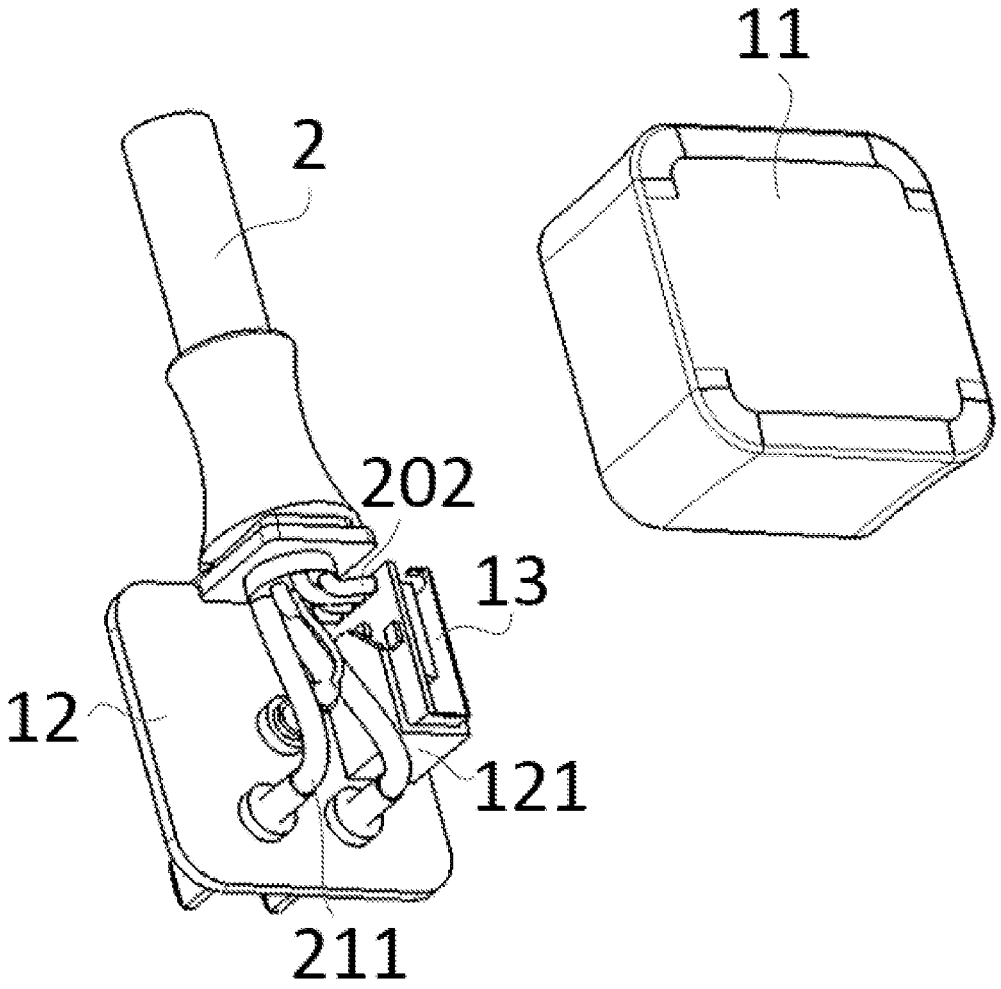
FIG. 6 is a second schematic diagram of the exploded structure of a plug with wireless communication of the invention.
Figure 7:
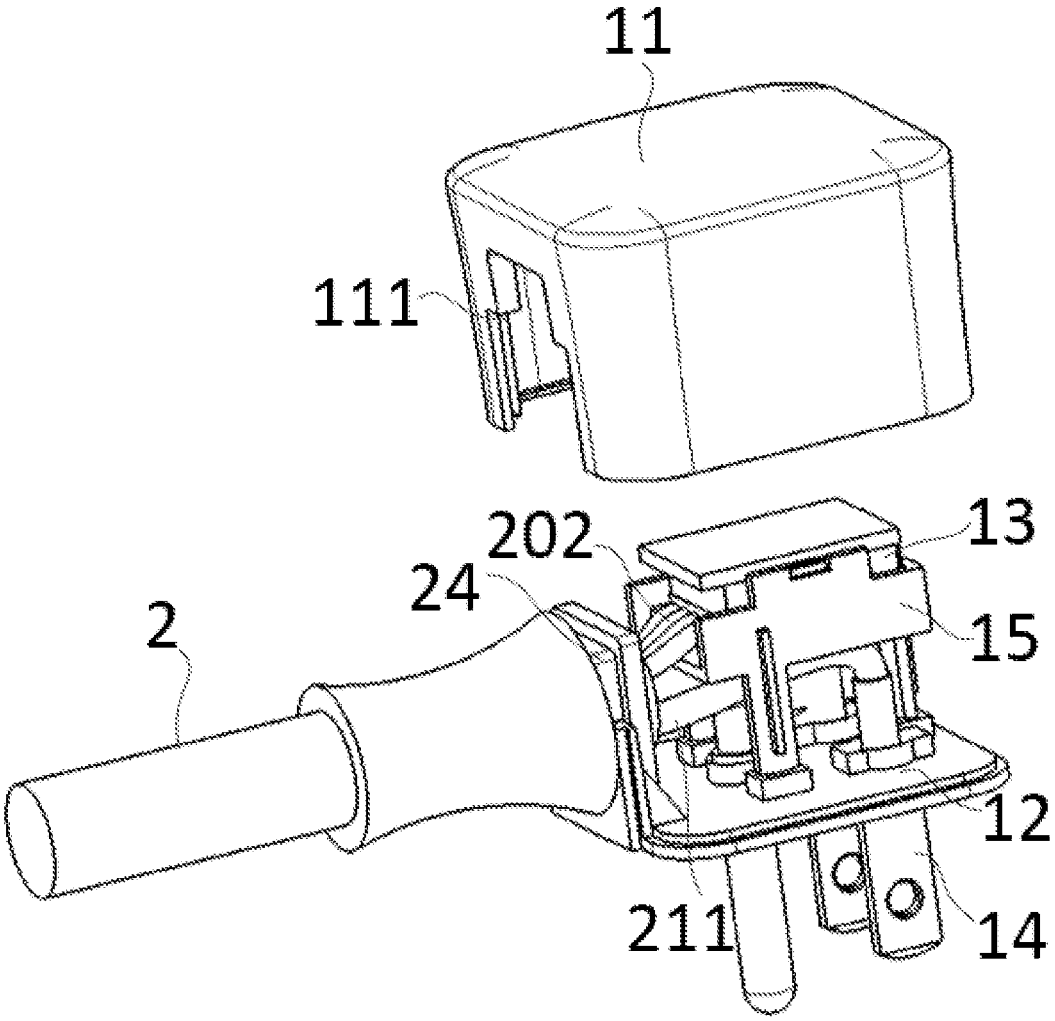
FIG. 7 is a third schematic diagram of the exploded structure of a plug with wireless communication of the invention.

In one embodiment, as shown in FIGS. 5-7, the housing preferably comprises an upper cover 11 and a lower cover 12. The upper cover 11 is of an open housing structure. Side surfaces of the upper cover 11 are recessed, which makes it more convenient for users to operate the upper cover 11 and improves the comfort of users. One of the side surfaces of the upper cover 11 is provided with a wire threading notch 111. An end of the cable 2 is provided with a clamping groove 24, and the clamping groove 24 cooperates with the wire threading notch 111.

Figure 8:
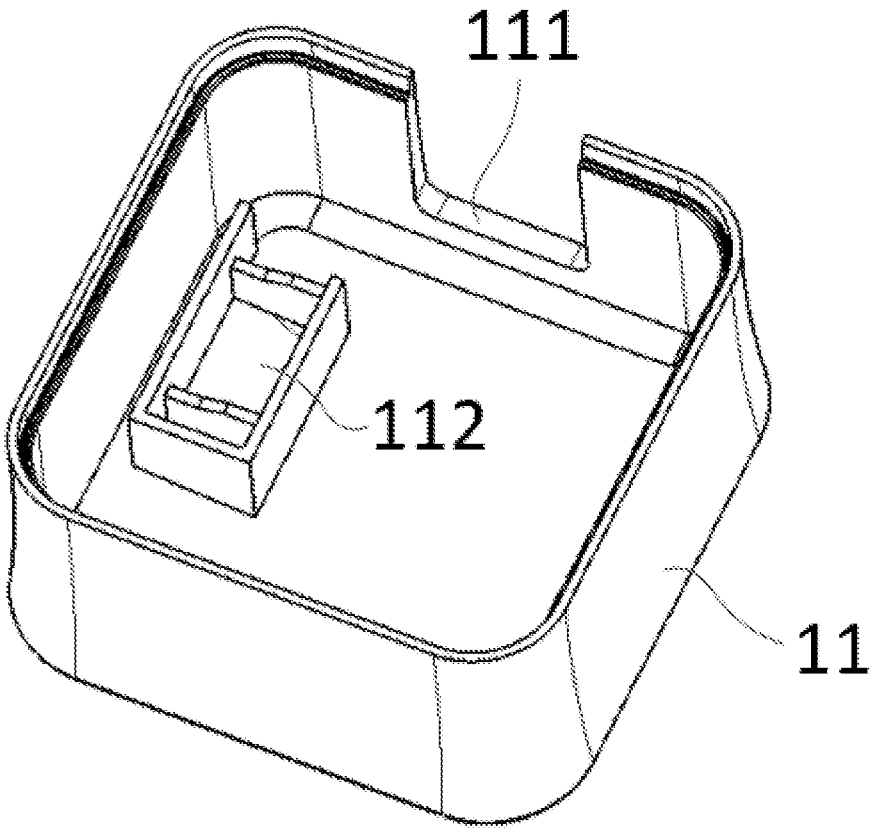
FIG. 8 is a schematic structural diagram of an upper cover according to an embodiment of the invention.

In one embodiment, as shown in FIG. 6, preferably, an inner surface of the lower cover 12 is provided with a mounting trough 121, and the wireless communication module 13 is mounted in the mounting trough 121. As shown in FIG. 7, the plug main body 1 further comprises a mounting bracket 15. The mounting bracket 15 is mounted on the inner surface of the lower cover 12. A wireless communication module 13 is mounted on the mounting bracket 15. The mounting bracket 15 is positioned above the power supply pins 14. By providing a mounting trough 121 integrated with an inner surface of the lower cover 12 or a mounting bracket 15 mounted on the inner surface of the lower cover 12, the plug can be assembled according to the actual situation of the wireless communication module 13 and the cable 2. As shown in FIG. 8, an inner surface of the upper cover 11 is provided with a positioning trough 112, and the positioning trough 112 presses against the wireless communication module 13. During installation, the wireless communication module 13 is first mounted in the mounting trough 121 or on the mounting bracket 15, and then the power wire 21 is connected to the power supply pins 14. Finally, during enclosure, the wire threading notch 111 is snapped into the clamping groove 24 to realize quick assembly of the plug.

Figure 3:
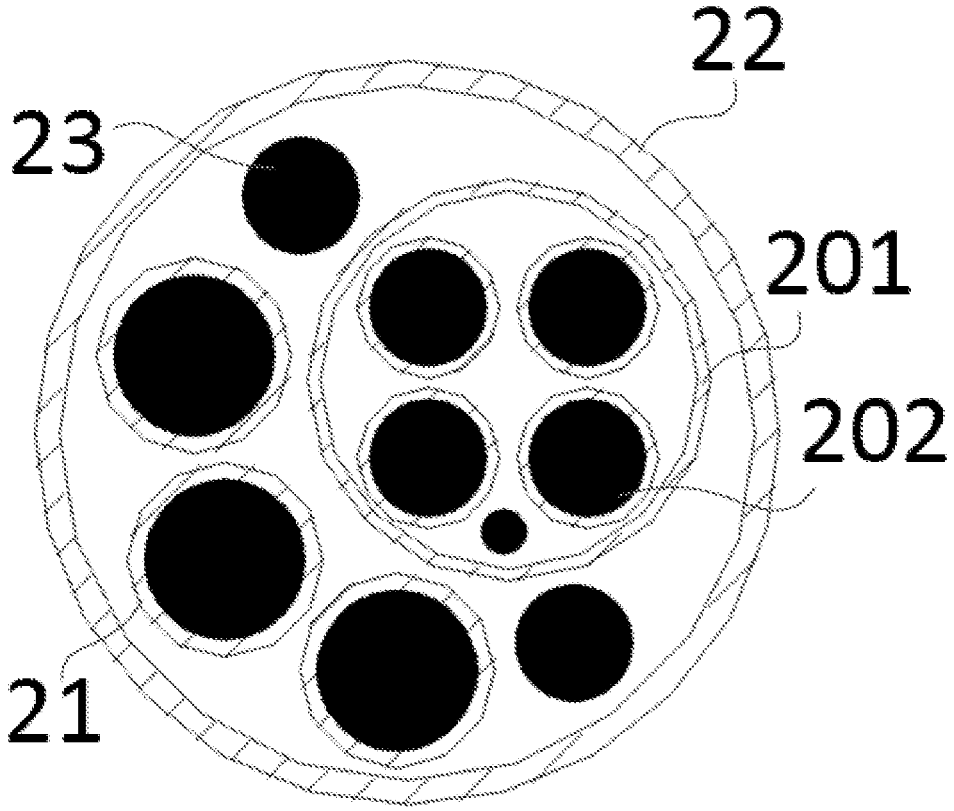
FIG. 3 is a second schematic diagram of the cross-sectional structure of a cable of the invention.
Figure 4:
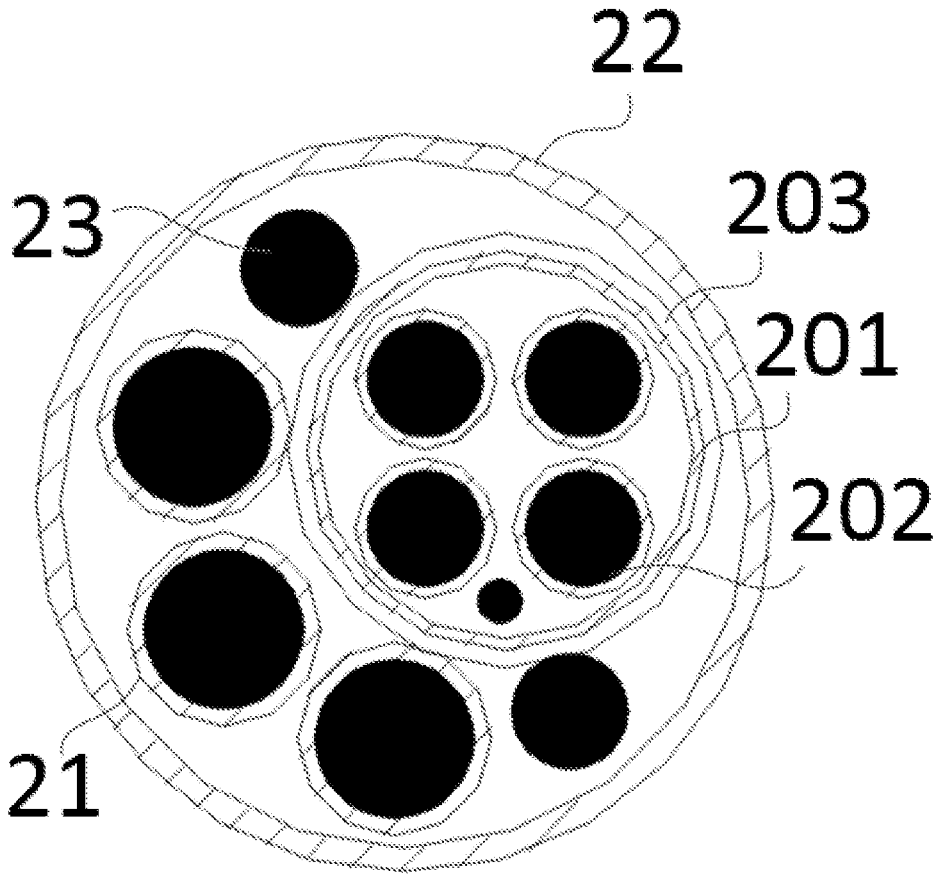
FIG. 4 is a third schematic diagram of the cross-sectional structure of a cable of the invention.

In one embodiment, as shown in FIGS. 2-4, preferably, the communication wire 20 sequentially comprises a signal wire 202 and a shielding layer 201 from inside to outside. The shielding layer 201 enwraps the signal wire 202 to isolate the power wire 21 from the signal wire 202, thus greatly improving the shielding effect, having strong anti-interference capability and improving the data transmission efficiency and quality.

In one embodiment, as shown in FIGS. 3 and 4, preferably, the cable 2 further comprises an inner cladding 203 and a filler 23, the inner cladding 203 enwraps the shielding layer 201, the filler 23 is arranged and distributed on the periphery of the communication wire 20, and the outer cladding 22 enwraps the power wire 21 and the filler 23.

In one embodiment, as shown in FIGS. 2-4, preferably, the power wire 21 comprises three power signal wires 211 with a specification ranging from 12 AWG to 20 AWG. In this embodiment, the specifications of the three power signal wires 211 are all 16 AWG. In the counter-clockwise direction, the colors of the three power signal wires 211 are white, black and green in sequence. When the cable 2 is assembled, the three power signal wires should be arranged strictly in the above sequence of the colors to facilitate connection with the corresponding power supply pins 14. The power supply pins 14 include a naught wire pin, a live wire pin and a ground wire pin, which are respectively connected to the power signal wires 211. In this embodiment, as shown in FIG. 1, the naught wire pin is specifically a naught wire inserting sheet, and the live wire pin is specifically a live wire inserting sheet. The naught wire inserting sheet and the live wire inserting sheet form a two-pin plug. A riveting process is used to realize the integration of the live wire inserting sheet, the naught wire inserting sheet and the lower cover 12, so as to increase the overall strength of the plug. In addition, after the upper cover 11 and the lower cover 12 are closed, the plug is compressed by ultrasonic welding, so as to realize the integral assembly of the plug. In this embodiment, as shown in FIG. 1, the ground wire pin is specifically a ground wire inserting column. The naught wire inserting sheet, the live wire inserting sheet and the ground wire inserting column form a three-pin plug. The ground wire inserting column uses a columnar structure, so that forces from all directions during the insertion process are the same, facilitating the use of users. As a rivet pressed structure is used, the problem in the industry that the welding of a charging plug tends to cause poor contact is solved.

In one embodiment, as shown in FIGS. 3 and 4, preferably, the signal wire 202 comprises four communication signal wires with a specification ranging from 24 AWG to 38 AWG and a communication ground wire with a specification ranging from 20 AWG to 26 AWG. The diameter of the communication signal wires is larger than communication ground wire's. In this embodiment, the specifications of the four communication signal wires are all 26 AWG and the specification of the one communication ground wire is 22 AWG. Starting from the communication signal wire in the first row and the first column, in the clockwise direction, the colors of the four communication signal wires are red, blue, brown and yellow in sequence. When the cable 2 is assembled, the four communication signal wires should be arranged strictly in the above sequence of the colors to facilitate the connection to corresponding wire pins of the wireless communication module 13. The shielding layer 201 enwraps the communication signal wires and the communication ground wire, and the communication signal wires and the communication ground wire are respectively connected to the wireless communication module 13. In this embodiment, the wireless communication module 13 comprises, but is not limited to, a Wi-Fi module, a Bluetooth communication module, or a ZigBee communication module. The wireless communication module 13 uses a PCB loaded structure. As shown in FIG. 6, the four communication signal wires and one communication ground wire of the signal wire 202 are welded to the wireless communication module 13 for transmitting data of electrical appliances. By providing different numbers of communication signal wires in the communication wire 20, corresponding cables 2 can be selected for assembly of the plug according to different wireless communication modules 13 in actual use, so as to meet different use requirements.

A plug with wireless communication, as shown in FIGS. 1 and 5, comprises a plug main body 1 and a cable 2. The plug main body 1 comprises a housing, a wireless communication module 13 and power supply pins 14. The wireless communication module 13 is mounted inside the housing. The housing comprises an upper cover 11 and a lower cover 12. An inner surface of the lower cover 12 is provided with a mounting member on which the wireless communication module 13 is mounted. As shown in FIG. 8, an inner surface of the upper cover 11 is provided with a positioning trough 112. The positioning trough 112 presses against the wireless communication module 13. The power supply pins 14 are riveted to the lower cover 12. The wireless communication module 13 and the power supply pins 14 are respectively connected to the cable 2. By mounting the wireless communication module 13 inside the plug main body 1, the interference with the wireless communication module 13 from various electrical appliances during operation is effectively reduced.

In one embodiment, as shown in FIGS. 5-7, preferably, the upper cover 11 is of an open housing structure. Side surfaces of the upper cover 11 are recessed, which makes it more convenient for users to operate the upper cover 11 and improves the comfort of users. One of the side surfaces of the upper cover 11 is provided with a wire threading notch 111. An end of the cable 2 is provided with a clamping groove 24, and the clamping groove 24 cooperates with the wire threading notch 111.

In one embodiment, as shown in FIGS. 6 and 7, preferably, the mounting member comprises a mounting trough 121 and a mounting bracket 15, the mounting trough 121 is provided on the inner surface of the lower cover 12, and the wireless communication module 13 is mounted in the mounting trough 121. The mounting bracket 15 is mounted on the inner surface of the lower cover 12. The wireless communication module 13 is mounted on the mounting bracket 15. The mounting bracket 15 is positioned above the power supply pins 14. By providing a mounting trough 121 integrated with an inner surface of the lower cover 12 or a mounting bracket 15 mounted on the inner surface of the lower cover 12, the plug can be assembled according to the actual situation of the wireless communication module 13 and the cable 2. During installation, the wireless communication module 13 is first mounted in the mounting trough 121 or on the mounting bracket 15, and then the power wire 21 is connected to the power supply pins 14. Finally, during enclosure, the wire threading notch 111 is snapped into the clamping groove 24 to realize quick assembly of the plug.

In one embodiment, as shown in FIGS. 2-4, preferably, the cable 2 sequentially comprises a communication wire 20, a power wire 21 and an outer cladding 22 from inside to outside. The communication wire 20 sequentially comprises a signal wire 202 and a shielding layer 201 from inside to outside. The shielding layer 201 enwraps the signal wire 202. The power wire 21 is arranged and distributed on the periphery of the communication wire 20. The outer cladding 22 enwraps the power wire 21, and the shielding layer 201 enwraps the signal wire 202 to isolate the power wire 21 from the signal wire 202, thus greatly improving the shielding effect, having strong anti-interference capability and improving the data transmission efficiency and quality. Preferably, the cable 2 further comprises an inner cladding 203 and a filler 23, the inner cladding 203 enwraps the shielding layer 201, the filler 23 is arranged and distributed on the periphery of the communication wire 20, and the outer cladding 22 enwraps the power wire 21 and the filler 23.

In one embodiment, as shown in FIGS. 2-4, preferably, the power wire 21 comprises three power signal wires 211 with a specification ranging from 12 AWG to 20 AWG. In this embodiment, the specifications of the three power signal wires 211 are all 16 AWG. In the counter-clockwise direction, the colors of the three power signal wires 211 are white, black and green in sequence. When the cable 2 is assembled, the three power signal wires should be arranged strictly in the above sequence of the colors to facilitate connection with the corresponding power supply pins 14. The power supply pins 14 include a naught wire pin, a live wire pin and a ground wire pin, which are respectively connected to the power signal wires 211. In this embodiment, as shown in FIG. 1, the naught wire pin is a naught wire inserting sheet, and the live wire pin is a live wire inserting sheet. The naught wire inserting sheet and the live wire inserting sheet form a two-pin plug. A riveting process is used to realize the integration of the live wire inserting sheet, the naught wire inserting sheet and the lower cover 12, so as to increase the overall strength of the plug. In addition, after the upper cover 11 and the lower cover 12 are closed, the plug is compressed by ultrasonic welding, so as to realize the integral assembly of the plug. In this embodiment, as shown in FIG. 1, the ground wire pin is specifically a ground wire inserting column. The naught wire inserting sheet, the live wire inserting sheet and the ground wire inserting column form a three-pin plug. The ground wire inserting column uses a columnar structure, so that forces from all directions during the insertion process are the same, facilitating the use of users. As a rivet pressed structure is used, the problem in the industry that the welding of a charging plug tends to cause poor contact is solved.

In one embodiment, as shown in FIGS. 3 and 4, preferably, the signal wire 202 comprises three communication signal wires with a specification ranging from 24 AWG to 38 AWG and a communication ground wire with a specification ranging from 20 AWG to 26 AWG. The diameter of the communication signal wires is larger than the diameter of the communication ground wire. In this embodiment, the specifications of the three communication signal wires are all 26 AWG, the specification of the one communication ground wire is 22 AWG. The shielding layer 201 enwraps the communication signal wires and the communication ground wire, and the communication signal wires and the communication ground wire are respectively connected to the wireless communication module 13. In this embodiment, the wireless communication module 13 is a Wi-Fi module, or a Bluetooth communication module, or a ZigBee communication module. The wireless communication module 13 uses the model MT7697, and the wireless communication module 13 uses a PCB loaded structure. The three communication signal wires and one communication ground wire of the signal wire 202 are welded to the wireless communication module 13 for transmitting data of electrical appliances. By providing different numbers of communication signal wires in the communication wire 20, corresponding cables 2 can be selected for assembly of the plug according to different wireless communication modules 13 in actual use, so as to meet different use requirements.

A plug with wireless communication, as shown in FIGS. 1 and 5, comprises a plug main body 1 and a cable 2. The plug main body 1 comprises a housing, a wireless communication module 13 and power supply pins 14. The wireless communication module 13 is mounted inside the housing. As shown in FIGS. 5-7, the housing comprises an upper cover 11 and a lower cover 12. The power supply pins 14 are riveted to the lower cover 12. The upper cover 11 is of an open housing structure. Side surfaces of the upper cover 11 are recessed, which makes it more convenient for users to operate the upper cover 11 and improves the comfort of users. One of the side surfaces of the upper cover 11 is provided with a wire threading notch 111. An end of the cable 2 is provided with a clamping groove 24, and the clamping groove 24 cooperates with the wire threading notch 111. The wireless communication module 13 and the power supply pins 14 are respectively connected to the cable 2. By mounting the wireless communication module 13 inside the plug main body 1, the interference with the wireless communication module 13 from various electrical appliances during operation is effectively reduced.

In one embodiment, as shown in FIG. 6, preferably, an inner surface of the lower cover 12 is provided with a mounting trough 121, and the wireless communication module 13 is mounted in the mounting trough 121. As shown in FIG. 7, the plug main body 1 further comprises a mounting bracket 15. The mounting bracket 15 is mounted on the inner surface of the lower cover 12. A wireless communication module 13 is mounted on the mounting bracket 15. The mounting bracket 15 is positioned above the power supply pins 14. By providing a mounting trough 121 integrated with an inner surface of the lower cover 12 or a mounting bracket 15 mounted on the inner surface of the lower cover 12, the plug can be assembled according to the actual situation of the wireless communication module 13 and the cable 2. As shown in FIG. 8, an inner surface of the upper cover 11 is provided with a positioning trough 112, and the positioning trough 112 presses against the wireless communication module 13. During installation, the wireless communication module 13 is first mounted in the mounting trough 121 or on the mounting bracket 15, and then the power wire 21 is connected to the power supply pins 14. Finally, during enclosure, the wire threading notch 111 is snapped into the clamping groove 24 to realize quick assembly of the plug.

In one embodiment, as shown in FIGS. 2-4, preferably, the cable 2 sequentially comprises a communication wire 20, a power wire 21 and an outer cladding 22 from inside to outside; and the communication wire 20 sequentially comprises a signal wire 202 and a shielding layer 201 from inside to outside. The shielding layer 201 enwraps the signal wire 202 to isolate the power wire 21 from the signal wire 202, thus greatly improving the shielding effect, having strong anti-interference capability and improving the data transmission efficiency and quality. The power wire 21 is arranged and distributed on the periphery of the communication wire 20, and the outer cladding 22 enwraps the power wire 21. Preferably, the cable 2 further comprises an inner cladding 203 and a filler 23, the inner cladding 203 enwraps the shielding layer 201, the filler 23 is arranged and distributed on the periphery of the communication wire 20, and the outer cladding 22 enwraps the power wire 21 and the filler 23.

In one embodiment, as shown in FIGS. 2-4, preferably, the power wire 21 comprises three power signal wires 211 with a specification ranging from 12 AWG to 20 AWG. In this embodiment, the specifications of the three power signal wires 211 are all 16 AWG. In the counter-clockwise direction, the colors of the three power signal wires 211 are white, black and green in sequence. When the cable 2 is assembled, the three power signal wires should be arranged strictly in the above sequence of the colors to facilitate connection with the corresponding power supply pins 14. The power supply pins 14 include a naught wire pin, a live wire pin and a ground wire pin, which are respectively connected to the power signal wires 211. In this embodiment, as shown in FIG. 1, the naught wire pin is specifically a naught wire inserting sheet, and the live wire pin is specifically a live wire inserting sheet. The naught wire inserting sheet and the live wire inserting sheet form a two-pin plug. A riveting process is used to realize the integration of the live wire inserting sheet, the naught wire inserting sheet and the lower cover 12, so as to increase the overall strength of the plug. In addition, after the upper cover 11 and the lower cover 12 are closed, the plug is compressed by ultrasonic welding, so as to realize the integral assembly of the plug. In this embodiment, as shown in FIG. 1, the ground wire pin is specifically a ground wire inserting column. The naught wire inserting sheet, the live wire inserting sheet and the ground wire inserting column form a three-pin plug. The ground wire inserting column uses a columnar structure, so that forces from all directions during the insertion process are the same, facilitating the use of users. As a rivet pressed structure is used, the problem in the industry that the welding of a charging plug tends to cause poor contact is solved. The signal wire 202 comprises two communication signal wires with a specification ranging from 24 AWG to 38 AWG and a communication ground wire with a specification ranging from 20 AWG to 26 AWG. The diameter of the communication signal wires is larger than the diameter of the communication ground wire. In this embodiment, the specifications of the two communication signal wires are all 26 AWG, the specification of the one communication ground wire is 22 AWG. The shielding layer 201 enwraps the communication signal wires and the communication ground wire, and the communication signal wires and the communication ground wire are respectively connected to the wireless communication module 13. In this embodiment, the wireless communication module 13 is a Wi-Fi module, a Bluetooth communication module, or a ZigBee communication module. The wireless communication module 13 uses the model MT7697, and the wireless communication module 13 uses a PCB loaded structure. The two communication signal wires and one communication ground wire of the signal wire 202 are welded to the wireless communication module 13 for transmitting data of electrical appliances. By providing different numbers of communication signal wires in the communication wire 20, corresponding cables 2 can be selected for assembly of the plug according to different wireless communication modules 13 in actual use, so as to meet different use requirements.

The invention provides a plug with wireless communication, and by riveting power supply pins to a lower cover and riveting the power supply pins to a power wire, the connection between the power supply pins and the lower cover and the power wire is firm and stable, the plug provides good contact, and the problem of poor contact of the plug in the prior art caused by using welding for connection is effectively solved. By mounting the wireless communication module inside the plug, the interference with the wireless communication module from various electrical appliances during operation is effectively reduced. By providing a mounting trough integrated with an inner surface of the lower cover or a mounting bracket mounted on the inner surface of the lower cover, the plug can be assembled according to the actual situation of the wireless communication module and the cable. By providing a communication wire inside the cable, the cable of the plug can transmit not only electric current but also communication signals. By enwrapping a signal wire with an inner cladding and a shielding layer, the power wire and the signal wire are isolated from each other, thus greatly improving the shielding effect, resulting in strong anti-interference capability and improving the data transmission efficiency and quality. By providing different numbers of communication signal wires in the communication wire, corresponding cables can be selected for assembly of the plug according to different wireless communication modules in actual use, so as to meet different use requirements. The plug of the invention is simple in structure, convenient in management of the cable, and easy to carry and use, facilitating people's work and life, and being conducive to widespread.

The foregoing has merely described the preferable embodiments of the invention, and is not intended to limit the invention in any form. Those of ordinary skill in the art can smoothly implement the invention as shown in the accompanying drawings and above of the description. However, equivalent changes such as alterations, modifications or variations made by those skilled in the art to the technical contents disclosed above without departing from the technical solutions of the invention are all equivalent embodiments of the invention. In addition, any equivalent changes such as alterations, modifications or variations made to the above embodiments according to the technical essence of the invention are still within the protection scope of the technical solutions of the invention.

I claim:

1. A plug with wireless communication, comprising: a plug main body and a cable, the plug main body comprising a housing, a wireless communication module and power supply pins; and the wireless communication module being mounted inside the housing, the power supply pins being connected to the housing, the cable sequentially comprising a communication wire, a power wire and an outer cladding from inside to outside, the outer cladding enwrapping the power wire and the communication wire, the wireless communication module being connected to the communication wire, and the power supply pins being connected to the power wire; wherein the housing comprises an upper cover and a lower cover, wherein an inner surface of the lower cover is provided with a mounting trough in which the wireless communication module is mounted; and an inner surface of the upper cover is provided with a positioning trough, the positioning trough pressing against the wireless communication module.

2. The plug with wireless communication of claim 1, the upper cover is of an open housing structure, side surfaces of the upper cover being recessed, and one of the side surfaces of the upper cover being provided with a wire threading notch; and an end of the cable is provided with a clamping groove which cooperates with the wire threading notch.

3. The plug with wireless communication of claim 1, wherein the communication wire sequentially comprises a signal wire and a shielding layer from inside to outside, and the shielding layer enwraps the signal wire.

4. The plug with wireless communication of claim 3, wherein the cable further comprises an inner cladding and a filler, the inner cladding enwraps the shielding layer, the filler is arranged and distributed on the periphery of the communication wire, and the outer cladding enwraps the power wire and the filler.

5. The plug with wireless communication of claim 3, wherein the power wire comprises three power signal wires with a specification ranging from 10 AWG to 22 AWG, the power supply pins include a naught wire pin and a live wire pin, and the naught wire pin and the live wire pin are respectively connected to the power signal wires.

6. The plug with wireless communication of claim 3, wherein the signal wire comprises four communication signal wires with a specification ranging from 18 AWG to 38 AWG and one communication ground wire with a specification ranging from 18 AWG to 26 AWG, the shielding layer enwraps the communication signal wires and the communication ground wire, and the communication signal wires and the communication ground wire are respectively connected to the wireless communication module.

7. A plug with wireless communication, comprising a plug main body and a cable, the plug main body comprising a housing, a wireless communication module and power supply pins; and the wireless communication module being mounted inside the housing, the housing comprising an upper cover and a lower cover, an inner surface of the lower cover being provided with a mounting member on which the wireless communication module is mounted, an inner surface of the upper cover being provided with a positioning trough, the positioning trough pressing against the wireless communication module, the power supply pins being riveted to the lower cover, and the wireless communication module and the power supply pins being respectively connected to the cable; wherein the mounting member comprises a mounting trough, and the mounting trough is provided on the inner surface of the lower cover, the wireless communication module being mounted in the mounting trough.

8. The plug with wireless communication of claim 7, wherein the upper cover is of an open housing structure, side surfaces of the upper cover being recessed, and one of the side surfaces of the upper cover being provided with a wire threading notch; and an end of the cable is provided with a clamping groove which cooperates with the wire threading notch.

9. The plug with wireless communication of claim 7, wherein the cable sequentially comprises a communication wire, a power wire and an outer cladding from inside to outside, the communication wire sequentially comprises a signal wire and a shielding layer from inside to outside, the shielding layer enwraps the signal wire, the power wire is arranged and distributed on the periphery of the communication wire, and the outer cladding enwraps the power wire.

10. The plug with wireless communication of claim 9, wherein the cable further comprises an inner cladding and a filler, the inner cladding enwraps the shielding layer, the filler is arranged and distributed on the periphery of the communication wire, and the outer cladding enwraps the power wire and the filler.

11. The plug with wireless communication of claim 9, wherein the power wire comprises three power signal wires with a specification ranging from 12 AWG to 20 AWG the power supply pins include a naught wire pin and a live wire pin, and the naught wire pin and the live wire pin are respectively connected to the power signal wires.

12. The plug with wireless communication of claim 9, wherein the signal wire comprises three communication signal wires with a specification ranging from 24 AWG to 38 AWG and one communication ground wire with a specification ranging from 20 AWG to 26 AWG, the shielding layer enwraps the communication signal wires and the communication ground wire, and the communication signal wires and the communication ground wire are respectively connected to the wireless communication module.

13. A plug with wireless communication, comprising a plug main body and a cable, the plug main body comprising a housing, a wireless communication module and power supply pins; and the wireless communication module being mounted inside the housing, the housing comprising an upper cover and a lower cover, the power supply pins being riveted to the lower cover, the upper cover being of an open housing structure, side surfaces of the upper cover being recessed, one of the side surfaces of the upper cover being provided with a wire threading notch, an end of the cable being provided with a clamping groove which cooperates with the wire threading notch, and the wireless communication module and the power supply pins being respectively connected to the cable; wherein an inner surface of the lower cover is provided with a mounting trough in which the wireless communication module is mounted.

14. The plug with wireless communication of claim 13, wherein an inner surface of the upper cover is provided with a positioning trough, the positioning trough pressing against the wireless communication module.

15. The plug with wireless communication of claim 13, wherein the cable sequentially comprises a communication wire, a power wire and an outer cladding from inside to outside, the communication wire sequentially comprises a signal wire and a shielding layer from inside to outside, the shielding layer enwraps the signal wire, the power wire is arranged and distributed on the periphery of the communication wire, and the outer cladding enwraps the power wire.

16. The plug with wireless communication of claim 15, wherein the cable further comprises an inner cladding and a filler, the inner cladding enwraps the shielding layer, the filler is arranged and distributed on the periphery of the communication wire, and the outer cladding enwraps the power wire and the filler.

17. The plug with wireless communication of claim 15, wherein the power wire comprises three power signal wires with a specification ranging from 12 AWG to 20 AWG, the power supply pins include a naught wire pin and a live wire pin, and the naught wire pin and the live wire pin are respectively connected to the power signal wires; and the signal wire comprises two communication signal wires with a specification ranging from 24 AWG to 38 AWG and one communication ground wire with a specification ranging from 20 AWG to 26 AWG, the shielding layer enwraps the communication signal wires and the communication ground wire, and the communication signal wires and the communication ground wire are respectively connected to the wireless communication module.

* * * * *